US011365621B2

(12) United States Patent
Samuel et al.

(10) Patent No.: US 11,365,621 B2
(45) Date of Patent: Jun. 21, 2022

(54) CASING WEAR CALCULATION

(71) Applicant: Landmark Graphics Corporation, Houston, TX (US)

(72) Inventors: Robello Samuel, Cypress, TX (US); Yuan Zhang, Missouri City, TX (US)

(73) Assignee: Landmark Graphics Corporation, Houston, TX (US)

( * ) Notice: Subject to any disclaimer, the term of this patent is extended or adjusted under 35 U.S.C. 154(b) by 196 days.

(21) Appl. No.: 16/758,027

(22) PCT Filed: Jun. 6, 2019

(86) PCT No.: PCT/US2019/035700
§ 371 (c)(1),
(2) Date: Apr. 21, 2020

(87) PCT Pub. No.: WO2020/246978
PCT Pub. Date: Dec. 10, 2020

(65) Prior Publication Data

US 2022/0003110 A1 Jan. 6, 2022

(51) Int. Cl.
*E21B 47/007* (2012.01)
*E21B 47/08* (2012.01)

(52) U.S. Cl.
CPC ..... *E21B 47/007* (2020.05); *E21B 47/08* (2013.01)

(58) Field of Classification Search
CPC ..... E21B 47/007; E21B 47/08
See application file for complete search history.

(56) References Cited

U.S. PATENT DOCUMENTS

| | | | |
|---|---|---|---|
| 9,659,113 | B2 | 5/2017 | Wicks et al. |
| 9,976,416 | B2 | 5/2018 | Samuel et al. |
| 2015/0226052 | A1 | 8/2015 | Samuel et al. |
| 2015/0240622 | A1 | 8/2015 | Bang et al. |
| 2016/0326844 | A1 | 11/2016 | Samuel et al. |
| 2017/0022798 | A1 | 1/2017 | Samuel et al. |
| 2017/0175515 | A1 | 6/2017 | Aniket et al. |
| 2017/0204720 | A1 | 7/2017 | Samuel et al. |
| 2018/0073347 | A1 | 3/2018 | Aniket et al. |
| 2018/0128095 | A1 | 5/2018 | Zhang et al. |
| 2018/0238165 | A1 | 8/2018 | Samuel |

FOREIGN PATENT DOCUMENTS

| | | |
|---|---|---|
| KR | 1020170091274 | 8/2017 |
| WO | 2016060684 | 4/2016 |

OTHER PUBLICATIONS

ISRWO International Search Report and Written Opinion for PCT/US2019/035700 dated Mar. 5, 2020.

*Primary Examiner* — Natalie Huls
*Assistant Examiner* — Cynthia L Davis
(74) *Attorney, Agent, or Firm* — Tenley Krueger; C. Tumey Law Group PLLC

(57) ABSTRACT

A method for calculating wellbore casing wear is provided that includes determining a wellbore boundary for an open hole wellbore segment, calculating a casing shape within the open hole wellbore segment based on one or more casing attributes, determining whether or not the casing shape exceeds the wellbore boundary, calculating casing wear based on the boundary of the open hole wellbore segment if the casing shape is determined to exceed the wellbore boundary, otherwise calculating the casing wear parameter based on the casing shape if the casing shape is determined not to exceed the wellbore boundary, and storing the casing wear parameter on a computer readable medium.

20 Claims, 4 Drawing Sheets

CASING WEAR CALCULATION

BACKGROUND

In the drilling of wellbores for hydrocarbon exploration and production, a portion of the wellbore will be drilled and cased with a casing, and thereafter the length of wellbore will be extended by further drilling. During the further drilling, the drill string extends through and contacts the casing, which contact by the drill string may cause casing wear. Casing wear may be particularly pronounced in deviated portions of the wellbore (i.e., those portions of the wellbore that are not vertically orientated). Accurate casing wear prediction is desirable for improving well integrity and longevity, while simultaneously making casing designs more efficient. However, at present, most casing wear calculations are based on wellbore survey data, which includes information such as the tortuosity of the open hole. A drawback to this approach is that estimates based on such calculations are susceptible to a degree of error thereby reducing the accuracy.

BRIEF DESCRIPTION OF THE DRAWINGS

These drawings illustrate certain aspects of some examples of the present disclosure and should not be used to limit or define the disclosure.

DETAILED DESCRIPTION

Figure 1:
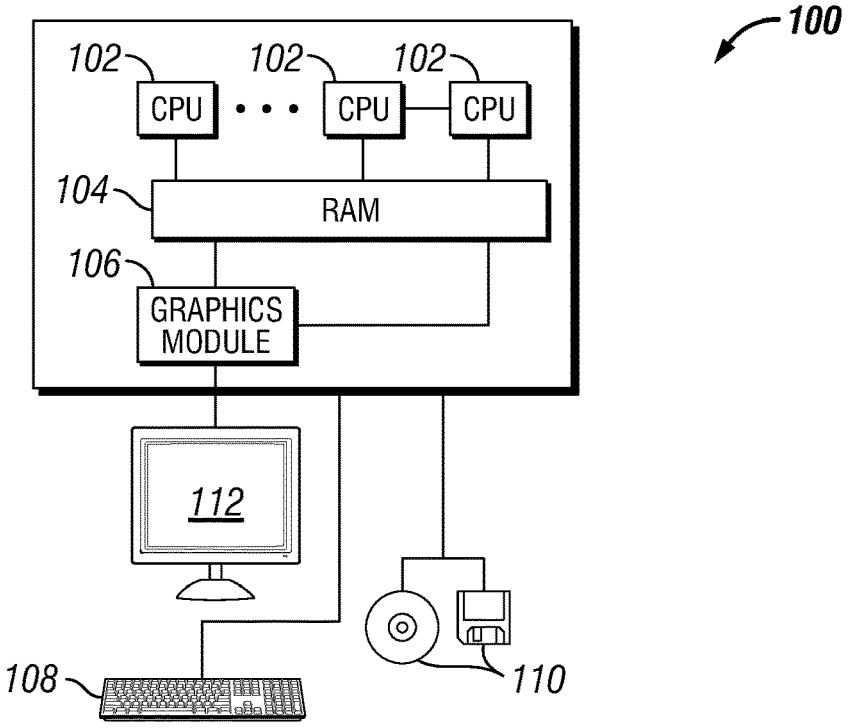
FIG. 1 illustrates an example of an information handling system.

Provided are systems and methods for corrosion prediction for assessing the integrity of metal tubular structures. According to some embodiments of the present disclosure, integrated solutions of corrosion analysis are provided which may enable end to end, lifetime well integrity management. In other aspects of the disclosure, corrosion prediction models are integrated with thermal flow models and stress analysis models. According to a further disclosure, the corrosion prediction package includes a model selection mechanism that is integrated with semi-empirical models, mechanistic models, and newly-developed correlations.

Embodiments of the present disclosure will be described more fully hereinafter with reference to the accompanying drawings in which like numerals represent like elements throughout the several figures, and in which example embodiments are shown. Embodiments of the claims may, however, be embodied in many different forms and should not be construed as limited to the embodiments set forth herein. The examples set forth herein are non-limiting examples and are merely examples among other possible examples.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

In the following description, numerous details are set forth to provide an understanding of the present disclosure. However, it will be understood by those of ordinary skill in the art that the present disclosure may be practiced without these details and that numerous variations or modifications from the described embodiments may be possible. The disclosure will now be described with reference to the figures, in which like reference numerals refer to like, but not necessarily the same or identical, elements throughout. For purposes of clarity in illustrating the characteristics of the present disclosure, proportional relationships of the elements have not necessarily been maintained in the figures.

Specific examples pertaining to the method are provided for illustration only. The arrangement of steps in the process or the components in the system described in respect to an application may be varied in further embodiments in response to different conditions, modes, and requirements. In such further embodiments, steps may be carried out in a manner involving different graphical displays, queries, analyses thereof, and responses thereto, as well as to different collections of data. Moreover, the description that follows includes exemplary apparatuses, methods, techniques, and instruction sequences that embody techniques of the disclosed subject matter. It is understood, however, that the described embodiments may be practiced without these specific details or employing only portions thereof.

FIG. 1 generally illustrates an example of an information handling system 100. The information handling system 100 may include any instrumentality or aggregate of instrumentalities operable to compute, estimate, classify, process, transmit, receive, retrieve, originate, switch, store, display, manifest, detect, record, reproduce, handle, or utilize any form of information, intelligence, or data for business, scientific, control, or other purposes. For example, an information handling system 100 may be a personal computer, a network storage device, or any other suitable device and may vary in size, shape, performance, functionality, and price. In examples, information handling system 100 may be referred to as a supercomputer or a graphics supercomputer.

As illustrated, information handling system 100 may include one or more central processing units (CPU) or processors 102. Information handling system 100 may also include a random-access memory (RAM) 104 that may be accessed by processors 102. It should be noted information handling system 100 may further include hardware or software logic, ROM, and/or any other type of nonvolatile memory. Information handling system 100 may include one or more graphics modules 106 that may access RAM 104. Graphics modules 106 may execute the functions carried out by a Graphics Processing Module (not illustrated), using hardware (such as specialized graphics processors) or a combination of hardware and software. A user input device 108 may allow a user to control and input information to information handling system 100. Additional components of the information handling system 100 may include one or more disk drives, output devices 112, such as a video display, and one or more network ports for communication with external devices as well as a user input device 108 (e.g., keyboard, mouse, etc.). Information handling system 100 may also include one or more buses operable to transmit communications between the various hardware components.

Alternatively, systems and methods of the present disclosure may be implemented, at least in part, with non-transitory computer-readable media. Non-transitory computer-readable media may include any instrumentality or aggregation of instrumentalities that may retain data and/or instructions for a period of time. Non-transitory computer-readable media may include, for example, storage media 110 such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

Figure 2:
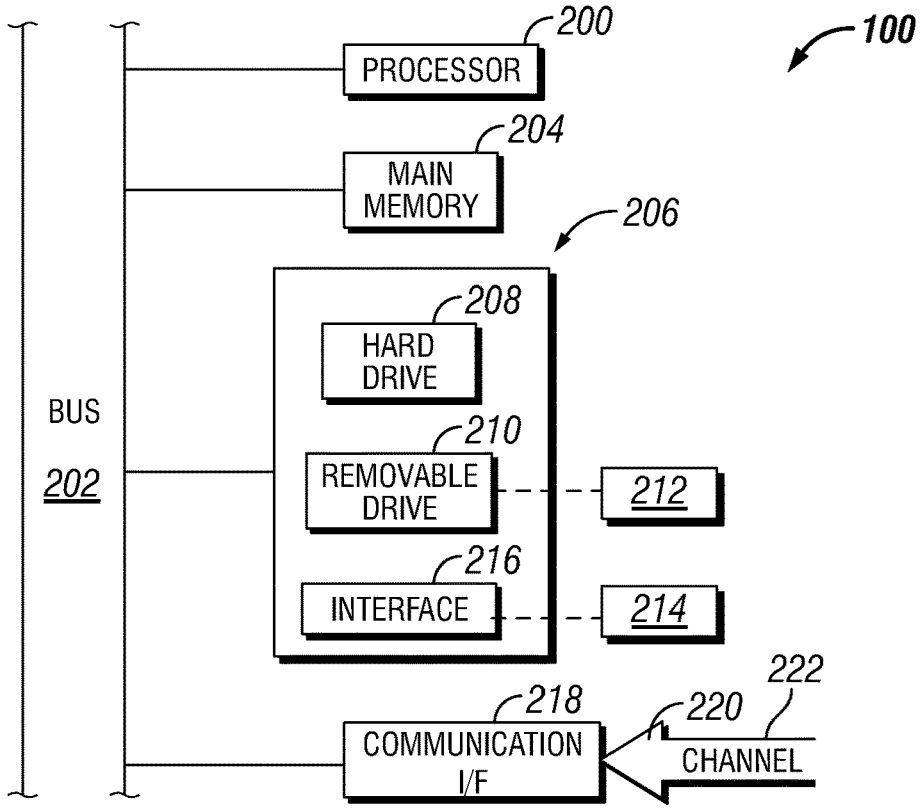
FIG. 2 illustrates another more detailed example of the information handling system.

FIG. 2 illustrates additional detail of information handling system 100. For example, information handling system 100 may include one or more processors, such as processor 200. Processor 200 may be connected to a communication bus 202. Various software embodiments are described in terms of this exemplary computer system. After reading this description, it will become apparent to a person skilled in the relevant art how to implement the example embodiments using other computer systems and/or computer architectures.

Information handling system 100 may also include a main memory 204, preferably random-access memory (RAM), and may also include a secondary memory 206. Secondary memory 206 may include, for example, a hard disk drive 208 and/or a removable storage drive 210, representing a floppy disk drive, a magnetic tape drive, an optical disk drive, etc. Removable storage drive 210 may read from and/or writes to a removable storage unit 212 in any suitable manner. Removable storage unit 212, represents a floppy disk, magnetic tape, optical disk, etc. which is read by and written to by removable storage drive 210. As will be appreciated, removable storage unit 212 includes a computer usable storage medium having stored therein computer software and/or data.

In alternative embodiments, secondary memory 206 may include other operations for allowing computer programs or other instructions to be loaded into information handling system 100. For example, a removable storage unit 214 and an interface 216. Examples of such may include a program cartridge and cartridge interface (such as that found in video game devices), a removable memory chip (such as an EPROM, or PROM) and associated socket, and other removable storage units 214 and interfaces 216 which may allow software and data to be transferred from removable storage unit 214 to information handling system 100.

In examples, information handling system 100 may also include a communications interface 218. Communications interface 218 may allow software and data to be transferred between information handling system 100 and external devices. Examples of communications interface 218 may include a modem, a network interface (such as an Ethernet card), a communications port, a PCMCIA slot and card, etc. Software and data transferred via communications interface 218 are in the form of signals 220 that may be electronic, electromagnetic, optical or other signals capable of being received by communications interface 218. Signals 220 may be provided to communications interface via a channel 222. Channel 222 carries signals 220 and may be implemented using wire or cable, fiber optics, a phone line, a cellular phone link, an RF link and/or any other suitable communications channels. For example, information handling system 100 includes at least one memory 204 operable to store computer-executable instructions, at least one communications interface 202, 218 to access the at least one memory 204; and at least one processor 200 configured to access the at least one memory 204 via the at least one communications interface 202, 218 and execute computer-executable instructions.

In this document, the terms "computer program medium" and "computer usable medium" are used to generally refer to media such as removable storage unit 212, a hard disk installed in hard disk drive 208, and signals 220. These computer program products may provide software to computer system 100.

Computer programs (also called computer control logic) may be stored in main memory 204 and/or secondary memory 206. Computer programs may also be received via communications interface 218. Such computer programs, when executed, enable information handling system 100 to perform the features of the example embodiments as discussed herein. In particular, the computer programs, when executed, enable processor 200 to perform the features of the example embodiments. Accordingly, such computer programs represent controllers of information handling system 100.

In examples with software implementation, the software may be stored in a computer program product and loaded into information handling system 100 using removable storage drive 210, hard disk drive 208 or communications interface 218. The control logic (software), when executed by processor 200, causes processor 200 to perform the functions of the example embodiments as described herein.

In examples with hardware implementation, hardware components such as application specific integrated circuits (ASICs). Implementation of such a hardware state machine so as to perform the functions described herein will be apparent to persons skilled in the relevant art(s). It should be noted that the disclosure may be implemented at least partially on both hardware and software.

Figure 3:
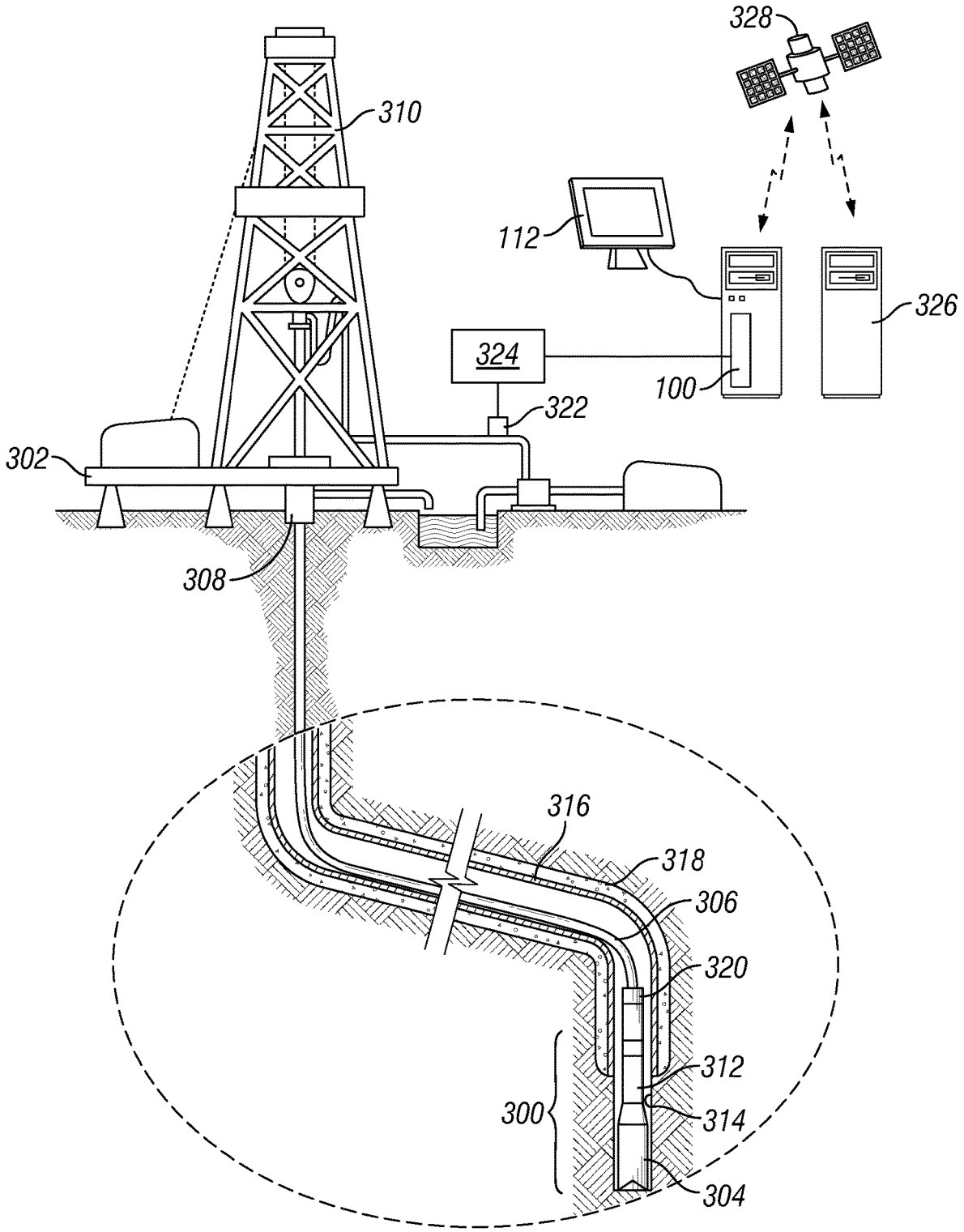
FIG. 3 illustrates a side elevation, partial cross-sectional view of an operational environment in accordance with one or more embodiments of the disclosure.

FIG. 3 shows an example land-based drilling operation. In particular, FIG. 3 shows a bottomhole assembly 300, where the bottomhole assembly 300 illustratively comprises a drill bit 304 on the distal end of the drill string 306. Various logging-while-drilling (LWD) and measuring-while-drilling 312 (MWD) tools may also be coupled within the bottomhole assembly 300. The drill string 306 (including the bottomhole assembly 300) is lowered from a drilling platform 302. The drill string 306 extends through well head 308. Drilling equipment supported within and around derrick 310 may rotate the drill string 306, and the rotational motion of the drill string 306 forms the wellbore 314. In the example of FIG. 3, the drill string 306 extends through a casing 316 illustratively held in place, at least in part, by cement 318. In the example shown the wellbore 314 extends beyond the distal end of the casing 316.

In accordance with at least some embodiments, the bottomhole assembly 300 may further comprise a communication subsystem. In particular, illustrative bottomhole assembly 300 comprises a telemetry module 320. Telemetry module 320 may communicatively couple to various logging while drilling (LWD) and/or measuring while drilling (MWD) 312 tools in the bottomhole assembly 300 and receive data measured and/or recorded by the tools. The telemetry module 320 may communicate logging data to the surface using any suitable communication channel (e.g., pressure pulses within the drilling fluid flowing in the drill string 306, acoustic telemetry through the pipes of the drill string 306, electromagnetic telemetry, optical fibers embedded in the drill string 306, or combinations), and likewise the telemetry module 320 may receive information from the surface over one or more of the communication channels.

In the illustrative case of the telemetry module 320 encoding data in pressure pulses that propagate to the surface by way of the drilling fluid in the drill string 306, transducer 322 converts the pressure signal into electrical signals for a signal digitizer 324 (e.g., an analog-to-digital converter). The digitizer 324 supplies a digital form of the pressure signals to information handling system 100 or some other form of a data processing device. Information handling system 100 operates in accordance with software (which may be stored on a computer-readable storage medium) to monitor and control the drilling processing, including instructions to calculate or estimate casing wear (discussed more thoroughly below). The Information handling system 100 is further communicatively coupled to many devices in and around the drilling site by way of digitizer 324, such as indications of the rotational speed (revolutions per minute (RPM)) of the drill string 306 and hook weight (related to weight-on-bit).

In some cases, the casing wear estimations of the example embodiments may be displayed on a display device 112. In yet still other example embodiments, the information handling system 100 may forward gathered data to another computer system, such as a computer system 326 at the operations center of the oilfield services provider, the operations center remote from the drill site. The communication of data between information handling system 100 and computer system 326 may take any suitable form, such as over the Internet, by way of a local or wide area network, or as illustrated over a satellite 328 link. Some or all of the calculations associated with aggregate casing wear may be performed at the computer system 326, and relayed back to the Information handling system 100 and display device 112.

In example systems, a value of aggregate casing wear provided to the driller may result in the driller making changes to drilling parameters associated with the drilling process. That is, when excess casing wear is predicted for a portion of the casing 316, the driller may make changes such as changing the rotational speed of the drill string, changing the weight-on-bit, and/or tripping the drill string (i.e., removing the drill string 306 from the casing 316) and changing a component of the bottomhole assembly and/or the drill string 306. For example, a portion of the bottomhole assembly 300 may be removed to change rotational vibration characteristics, or to shorten/lengthen the bottomhole assembly 300. A shorter or longer bottomhole assembly 300 may relocate the contact point of tools joints in the drill string 306 against the inside diameter of the casing 316.

It is noted, however, that FIG. 3 is simplified for purposes of explanation, and the relative sizes of the various components are not drawn to scale. For example, in actual drilling the turning radius for changes in direction may be on the order 3000 feet or more, and thus the bends in the example wellbore of FIG. 3 are not shown to scale. As another example, the relative sizes of the drill string 306 and casing 316 are exaggerated to convey certain concepts related to casing wear modes contemplated by the various embodiments.

Moreover, the drill string 306, though shown as continuous, actually comprises a series of pipe sections (e.g., 30 foot sections, or 40 foot sections) coupled together piece-by-piece as the drill string is lowered into the wellbore. The pipe sections that create the overall drill string have threads on each end—one male or "pin" end with external threads and one female or "box" end with internal threads. The pin end of one drill pipe couples to the box end of the next drill pipe. In many cases, particularly cases of small outside diameter drill pipe, the box end of the pipe defines a larger cross-sectional area (i.e., has a larger diameter) than, for example, in the middle of the pipe section. Moreover, the larger diameter associated with the box end may be hardened or have a protective coating, which protective coating reduces wear on the pipe section but may accelerate casing wear. The larger diameter portions of the drill pipe may be referred to as "tool joints" in the industry.

During drilling operations, as illustrated in FIG. 3, casing 316 may be damaged by drill string 306 as drill string 306 rotates within wellbore 314. The wearing down of casing 316 over time is defined as casing wear. Calculating the speed of casing wear may allow for the calculation of casing thickness that may be suitable for the life of the well. Information handling system 100 may further provide processing and storing of measurements gathered by the sensors such as 312, 320, 322, and 324 to calculate casing wear. As discussed with respect to FIGS. 1 and 2, information handling system 100 may include a non-transitory computer-readable medium (e.g., a hard-disk drive and/or memory) capable of executing instructions to perform such tasks. In addition to collecting and processing measurements, information handling system 100 may be capable of controlling the drill string 306 and LWD and/or MWD 312 tools. The memory of information handling system 100 may include a casing wear estimation program which, when executed, estimates a side force of a tubular string (e.g., the drill string 306) against the inner wall of the casing 316, accounting for a bending stiffness of the tubular string. The program further determines, based at least in part on the side force, a casing string wear volume as a function of position along the casing string, and may present the determined wear volume to a user via a display, such as computer monitor 112.

In example systems, a value of aggregate casing wear may be provided to drilling engineers and may result in changes to drilling parameters associated with the drilling process. That is, when excess casing wear is predicted for a portion of the casing 316, the drilling engineers may make changes such as changing the rotational speed of the drill string 306, changing the weight-on-bit, and/or tripping the drill string 306 (i.e., removing the drill string from the casing 316) and changing a component of the bottom hole assembly 300 and/or the drill string 306. For example, a portion of the bottomhole assembly 300 may be removed to change rotational vibration characteristics, or to shorten/lengthen the bottomhole assembly 300. A shorter or longer bottomhole assembly 300 may relocate the contact point of tool joints in the drill string 306 against the inside diameter of the casing 316.

The speed of casing wear may be related to the tortuosity of wellbore 314. In examples, the shape of an uncased wellbore 314 may be different than the shaped of a cased wellbore 314 as casing 316 may correct the tortuosity of wellbore 314. However, tortuosity may increase the friction force on casing 316 due at least in part on the tortuosity shape of casing 316, which may concentrate frictional forces at a few peak points and valley points. A tortuosity shape of casing 316 may be formed during cementing operations at which time casing 316 may be run into wellbore 314. In examples, straight casing 316 may be run into an open hole wellbore 314. Casing 316 may remain straight or bend at different points along casing 316. If casing 316 keeps a straight shape then the tortuosity of the open hole wellbore 314 may be removed after cementing operations.

In at least some examples, a casing wear program may calculate the tortuosity of wellbore 314. Additionally, the casing wear program may employ a stiff string and/or finite element model in estimating the side force. The side force may be combined with measurements or estimates of other parameters such as a wear factor, rotational speed of the tubular string, and drilling time, to estimate the casing wear volume. Moreover, the program may acquire measurements of the wear volume of the casing string and based thereon may update prior estimates of the model parameters such as the wear factor.

Figure 4A:
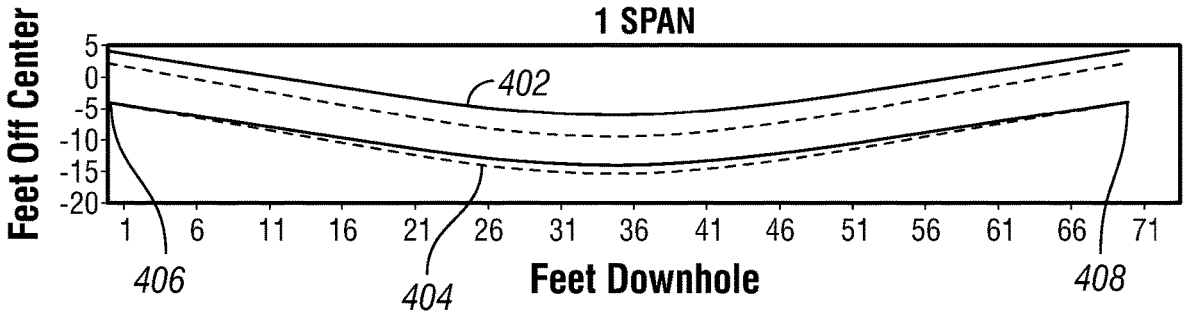
FIGS. 4A-C illustrate casing deflection across multiple open well tortuosity types.
Figure 4B:
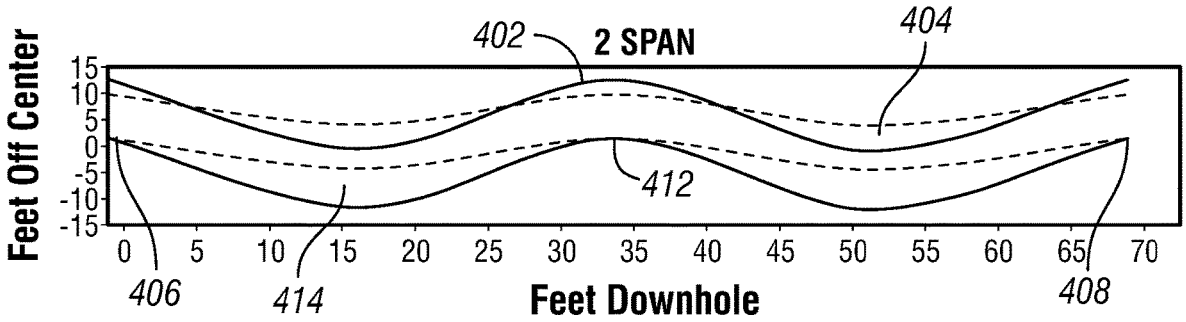
Figure 4C:
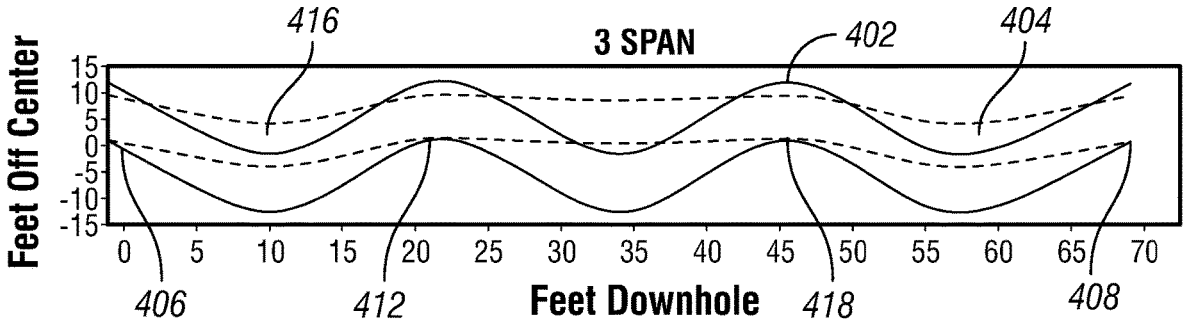

FIGS. 4A-C illustrate casing deflection across multiple open well tortuosity types. One factor affecting the speed of casing wear is related to the tortuosity of the wellbore. The shape of the open well may be different to the shape of the cased well because the casing may reduce the tortuosity. The present disclosure provides a way to make a more accurate tortuosity determination from open well survey data after it is cemented. The tortuosity of a well may influence casing wear calculation. This is at least partly due to the tortuosity increase the friction force on the casing wall, partly because the tortuosity shape of the casing may concentrate the friction force at a few peak and valley points.

When cementing, casing is run into an open hole wellbore. The casing may be bent by the snake-shape of the wellbore or maintain a straight shape. If the casing pipe maintains a straight shape, the tortuosity of the open hole wellbore will be reduced after cementing. As shown in FIG. 4A, a 1-span tortuosity segment of the wellbore is shown. An open hole wellbore segment is illustrated on FIG. 4A by reference number 402. The shape of the casing segment is illustrated on FIG. 4A by reference number 404 with casing segment 404 being supported on two end points 406, 408 of this 1-span tortuosity wellbore segment. The casing segment 404 will bend down due to the load of its self-weight. The shape of the casing segment 404 in the open hole wellbore segment 402 may be calculated using a number of values including stiffness of the casing, casing length, and casing self-weight.

If casing segment 404 lies out of the boundary of the open hole segment 402, the deflection of the casing on its self-weight is larger than the deflection of the wellbore, however, the wall of the wellbore should prevent deformation when the casing wall reaches the wall of the wellbore. In this example, the tortuosity of the casing segment 404 is same to the tortuosity of the open hole wellbore segment 402. Accordingly, drilling engineers may use the open well survey data to estimate the casing wear for this casing segment 404.

If casing segment 404 lies inside the boundary of the open hole wellbore segment 402, the deflection of the casing on its self-weight is less than the deflection of the open hole wellbore segment 402. In this example, the casing segment 404 has lower tortuosity than the open hole wellbore segment 402. Accordingly, drilling engineers may use the deformed casing shape of the casing segment 404 to estimate the casing wear for this casing segment 404.

The casing shape on self-weight for 2 spans and 3 spans is shown in FIGS. 4B and 4C, respectively. Similar to the 1-span tortuosity, reference number 402 is the shape of the open hole wellbore segment, and reference number 404 indicates the shape of the casing segment on its self-weight. The shape of the casing on its self-weight may be calculated using finite element method or continue-beam theory which is given below as:

$$\{F\}=[K]\{\Delta\} \tag{1}$$

where F is force, K is stiffness and Δ=length.

Similarly, if casing segment 404 lies within the boundary of the shape of the open hole wellbore segment 402, then the shape of the casing segment 404 after cementing will have less tortuosity than the tortuosity of the open hole wellbore segment 402. Accordingly, drilling engineers may use the deformed casing shape of the casing segment 404 to estimate the casing wear in this scenario. In FIG. 4B, the shape of the casing segment 404 is a 2-span tortuosity wellbore segment, which is supported on three points 406, 408, 412. In FIG. 4C, reference number 404 indicates the shape of the casing segment, which is supported on four points 406, 408, 412, and 418.

If the shape of the casing segment 404 exceeds the shape of the open hole wellbore segment 402, the casing deflection at the point will be prevented by the wall of wellbore. At which point the shape of the casing segment 404 may be adjusted to the boundary of the open hole wellbore 410, 414, and 416, and the shape of the casing segment 404 after cementing may be estimated. The drilling engineer may use the adjusted casing well shape to calculate the shape of the casing segment 404.

Figure 5:
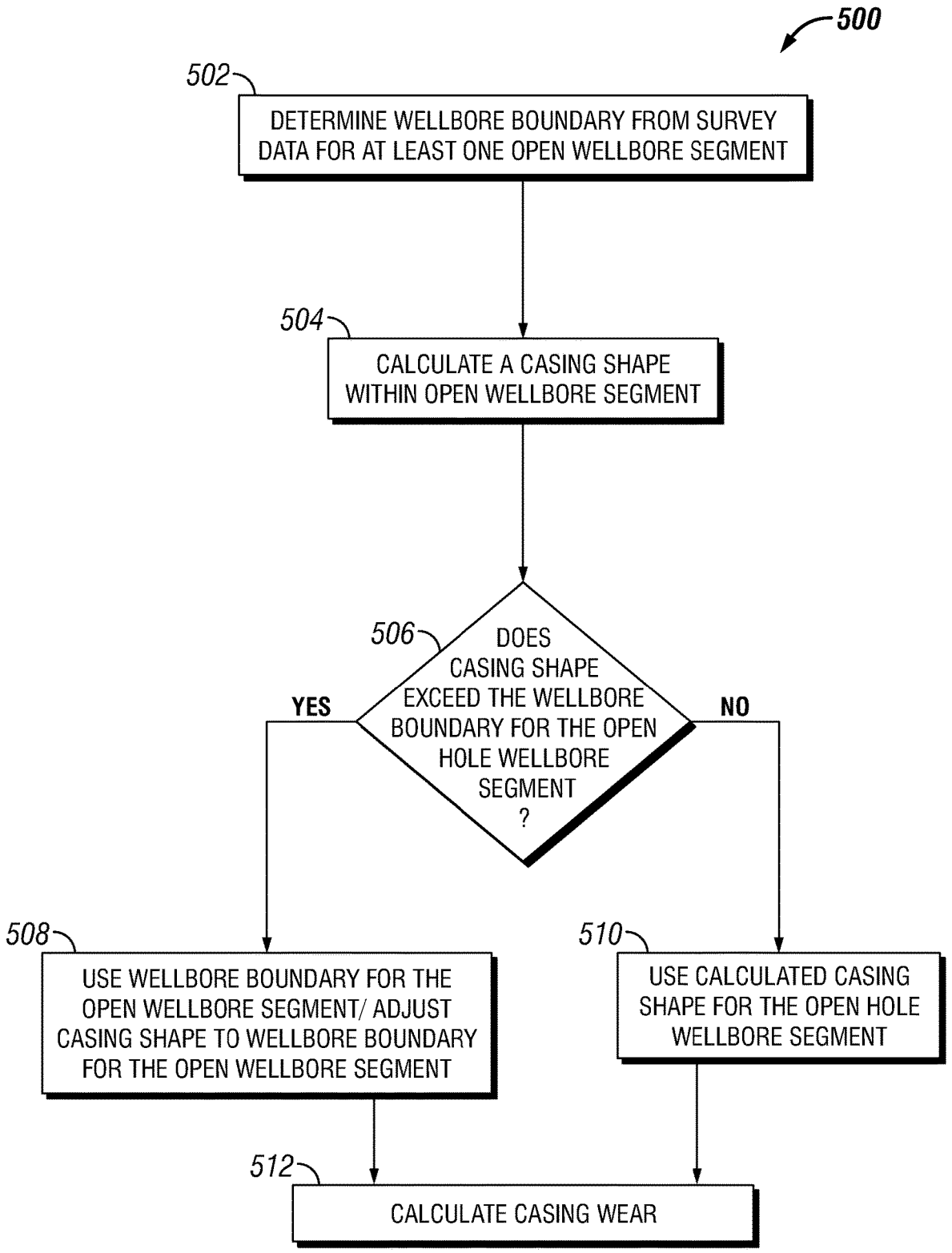
FIG. 5 illustrates a workflow for determining a wellbore casing segment.

FIG. 5 illustrates a workflow 500 for determining casing wear according to one or more embodiments of the present disclosure. In FIG. 5, workflow 500 may be processed by information handling system 100 (e.g., referring to FIGS. 1 and 2) to determine and provide an integrity assessment. It should be noted that workflow 500 may be implemented by information handling system 100 as either software which may be disposed on main memory 204 or secondary memory 206 (e.g., referring to FIG. 2). As illustrated in FIG. 5, workflow 500 may begin with block 502, wherein an open hole wellbore boundary is obtained from survey data for at least one open hole wellbore segment. According to other embodiments, the wellbore boundary may be calculated or otherwise determined from survey data. Survey data may include tortuosity information about the open hole wellbore and a wellbore boundary may be obtained, retrieved, or derived from such information. In block 504, a casing shape is calculated for casing 316 (e.g., referring to FIG. 3) disposed within the open hole wellbore segment. The casing shape may be calculated in a number of ways including in accordance with continuous beam, finite element method, or other formulae, such as that discussed with respect to FIGS. 4A-5C. In block 506, a determination is made as to whether or not the shape of casing 316 disposed within the open hole wellbore segment exceeds the wellbore boundary. The wellbore boundary is defined as the wall of wellbore 314 (e.g., referring to FIG. 3) formed during drilling operations. If yes, then block 508 provides that the wellbore boundary information is to be used for the cased segment for further operations, such as estimating casing wear. If no, then block 510 provides that the calculated casing shape is to be used for the cased segment. In block 512, casing wear is calculated for a cased wellbore segment. If the casing shape exceeds the wellbore boundary, as determined in block 506, then casing wear may be calculated using the wellbore boundary. Additionally, or in conjunction with the wellbore boundary, the shape of casing 316 may be determined and used in calculating casing wear. If it is determined in block 506, that the casing shape does not exceed the wellbore boundary, then casing wear may be calculated using the calculated casing shape for the wellbore segment.

The preceding description provides various examples of the systems and methods of use disclosed herein which may contain different method steps and alternative combinations of components. Among other things, improvements over current technology include novel corrosion prediction for integrity assessment of metal tubular structures.

Statement 1. A method for calculating wellbore casing wear may comprise determining a wellbore boundary for an open hole wellbore segment, calculating a casing shape within the open hole wellbore segment based on one or more casing attributes, determining whether or not the casing shape exceeds the wellbore boundary, calculating casing wear based on the boundary of the open hole wellbore segment if the casing shape is determined to exceed the wellbore boundary, otherwise calculating the casing wear based on the casing shape if the casing shape is determined not to exceed the wellbore boundary, and storing the casing wear parameter on a computer readable medium.

Statement 2. The method of statement 1, wherein the one or more casing attributes includes a casing length, a casing stiffness, and a casing self-weight.

Statement 3. The method of statements 1 or 2, wherein the step of calculating a casing shape utilizes continuous beam theory.

Statement 4. The method of statements 1-3, wherein the step of determining a wellbore boundary for an open hole wellbore segment is at least partially based on a tortuosity parameter of the open hole wellbore segment.

Statement 5. The method of statements 1-4, wherein the step of determining a wellbore boundary for an open hole wellbore segment is based at least in part on survey data.

Statement 6. The method of statements 1-5, wherein the one or more casing attributes includes a casing length, a casing stiffness, and a casing self-weight and wherein the step of calculating a casing shape utilizes continuous beam theory.

Statement 7. The method of statement 6, wherein the step of determining a wellbore boundary for an open hole wellbore segment is based at least in part on survey data.

Statement 8. A method may comprise receiving a wellbore tortuosity for one or more open hole wellbore segments, calculating a wellbore boundary for the one or more open hole wellbore segments using the wellbore tortuosity, calculating a casing deflection within the one or more open hole wellbore segments based at least in part on one or more casing attributes, determining whether or not the casing deflection exceeds the wellbore boundary, calculating casing wear based on a wellbore tortuosity parameter if the casing deflection is outside the wellbore boundary, calculating the casing wear based on a deformed casing shape if the casing deflection is inside the wellbore boundary, calculating the casing wear based on an adjusted casing shape parameter if the casing deflection is outside the wellbore boundary, and recording the casing wear on one or more tangible, non-volatile computer-readable media thereby creating a casing wellbore wear product.

Statement 9. The method of statement 8 wherein the one or more casing attributes includes a casing length, a casing stiffness, and a casing self-weight.

Statement 10. The method of statements 8 or 9, wherein the step of calculating a casing deflection utilizes continuous beam theory.

Statement 11. The method of statements 8-10, wherein the step of calculating a boundary of an open hole wellbore segment is at least partially based on a tortuosity of the one or more open hole wellbore segments.

Statement 12. The method of statements 8-11, the step of calculating a casing deflection within the one or more open hole wellbore segments is based at least in part on one or more casing attributes and the wellbore tortuosity.

Statement 13. The method of statements 8-12, wherein the one or more casing attributes includes a casing length, a casing stiffness, and a casing self-weight and wherein the step of calculating a casing deflection utilizes continuous beam theory.

Statement 14. A system for assessing wellbore casing wear may comprise an information handling system. The information handling system may comprise at least one memory operable to store computer-executable instructions, at least one communications interface to access the at least one memory and at least one processor configured to access the at least one memory via the at least one communications interface and execute the computer-executable instructions. Instructions may include receive one or more wellbore tortuosity inputs for one or more open hole wellbore segments, calculate a wellbore boundary based on the one or more wellbore tortuosity inputs, calculate a casing shape within the one or more open hole wellbore segments based on one or more casing attributes, determine whether or not the casing shape exceeds the wellbore boundary, calculate a casing wear parameter based on the wellbore boundary of the one or more open hole wellbore segments if the casing shape is determined to exceed the wellbore boundary, otherwise calculate the casing wear parameter based on the casing shape if the casing shape is determined not to exceed the wellbore boundary, and store the casing wear on a computer readable medium.

Statement 15. The system of statement 14, wherein the one or more casing attributes include a casing length, a casing stiffness, and a casing self-weight.

Statement 16. The system of statements 14 or 15, wherein the computer-executable instructions to calculate a casing shape utilizes continuous beam theory.

Statement 17. The system of statements 14-16, wherein the computer-executable instructions to receive one or more wellbore tortuosity inputs for one or more open hole wellbore segments receives the one or more tortuosity inputs from a wellbore survey data.

Statement 18. The system of statements 14-17, wherein the computer-executable instructions to determine a wellbore boundary for an open hole wellbore segment is based at least in part on survey data.

Statement 19. The system of statement 18, wherein the computer-executable instructions to calculate a casing shape utilizes continuous beam theory.

Statement 20. The system of statements 14-18, wherein the computer-executable instructions to calculate a casing shape within the one or more open hole wellbore segments is based on one or more casing attributes and the one or more wellbore tortuosity inputs.

It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only, and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A method for calculating wellbore casing wear comprising:

transmitting a pressure signal into a wellbore with a transducer;

recording a reflection of the pressure signal with the transducer;

processing the reflection of the pressure signal to form one or more casing attributes;

determining a wellbore boundary for an open hole wellbore segment;

calculating a casing shape within the open hole wellbore segment based on the one or more casing attributes;

determining whether or not the casing shape exceeds the wellbore boundary;

calculating casing wear based on the boundary of the open hole wellbore segment if the casing shape is determined to exceed the wellbore boundary;

otherwise calculating the casing wear based on the casing shape if the casing shape is determined not to exceed the wellbore boundary; and storing the casing wear on a computer readable medium.

2. The method of claim 1, wherein the one or more casing attributes includes a casing length, a casing stiffness, and a casing self-weight.

3. The method of claim 1, wherein the step of calculating a casing shape utilizes continuous beam theory.

4. The method of claim 1, wherein the step of determining a wellbore boundary for an open hole wellbore segment is at least partially based on a tortuosity parameter of the open hole wellbore segment.

5. The method of claim 1, wherein the step of determining a wellbore boundary for an open hole wellbore segment is based at least in part on survey data.

6. The method of claim 1, wherein the one or more casing attributes includes a casing length, a casing stiffness, and a casing self-weight and wherein the step of calculating a casing shape utilizes continuous beam theory.

7. The method of claim 6, wherein the step of determining a wellbore boundary for an open hole wellbore segment is based at least in part on survey data.

8. A method comprising:

transmitting a pressure signal into a wellbore with a transducer;

recording a reflection of the pressure signal with the transducer;

processing the reflection of the pressure signal to form a wellbore tortuosity;

receiving the wellbore tortuosity for one or more open hole wellbore segments;

calculating a wellbore boundary for the one or more open hole wellbore segments using the wellbore tortuosity;

calculating a casing deflection within the one or more open hole wellbore segments based at least in part on one or more casing attributes;

determining whether or not the casing deflection exceeds the wellbore boundary; calculating casing wear based on a wellbore tortuosity parameter if the casing deflection is outside the wellbore boundary;

calculating the casing wear based on a deformed casing shape if the casing deflection is inside the wellbore boundary;

calculating the casing wear based on an adjusted casing shape parameter if the casing deflection is outside the wellbore boundary; and recording the casing wear on one or more tangible, non-volatile computer-readable media thereby creating a casing wellbore wear product.

9. The method of claim 8 wherein the one or more casing attributes includes a casing length, a casing stiffness, and a casing self-weight.

10. The method of claim 8, wherein the step of calculating a casing deflection utilizes continuous beam theory.

11. The method of claim 8, wherein the step of calculating a boundary of an open hole wellbore segment is at least partially based on a tortuosity of the one or more open hole wellbore segments.

12. The method of claim 8, the step of calculating a casing deflection within the one or more open hole wellbore segments is based at least in part on one or more casing attributes and the wellbore tortuosity.

13. The method of claim 8, wherein the one or more casing attributes includes a casing length, a casing stiffness, and a casing self-weight and wherein the step of calculating a casing deflection utilizes continuous beam theory.

14. A system for assessing wellbore casing wear comprising:

a transducer to transmit a pressure signal into a wellbore and record a reflection of the pressure signal;

an information handling system comprising:

at least one memory operable to store computer-executable instructions;

at least one communications interface to access the at least one memory; and at least one processor configured to access the at least one memory via the at least one communications interface and execute the computer-executable instructions to:

process the reflection of the pressure signal to form a wellbore tortuosity;

receive the wellbore tortuosity for one or more open hole wellbore segments;

calculate a wellbore boundary based on the one or more wellbore tortuosity inputs;

calculate a casing shape within the one or more open hole wellbore segments based on one or more casing attributes;

determine whether or not the casing shape exceeds the wellbore boundary;

calculate a casing wear based on the wellbore boundary of the one or more open hole wellbore segments if the casing shape is determined to exceed the wellbore boundary;

otherwise calculate the casing wear based on the casing shape if the casing shape is determined not to exceed the wellbore boundary; and store the casing wear on a computer readable medium.

15. The system of claim 14, wherein the one or more casing attributes include a casing length, a casing stiffness, and a casing self-weight.

16. The system of claim 14, wherein the computer-executable instructions to calculate a casing shape utilizes continuous beam theory.

17. The system of claim 14, wherein the computer-executable instructions to receive one or more wellbore tortuosity inputs for one or more open hole wellbore segments receives the one or more tortuosity inputs from a wellbore survey data.

18. The system of claim 17, wherein the computer-executable instructions to determine a wellbore boundary for an open hole wellbore segment is based at least in part on survey data.

19. The system of claim 18, wherein the computer-executable instructions to calculate a casing shape utilizes continuous beam theory.

20. The system of claim 14, wherein the computer-executable instructions to calculate a casing shape within the one or more open hole wellbore segments is based on one or more casing attributes and the one or more wellbore tortuosity inputs.

* * * * *